US009291390B2

(12) United States Patent
Eilers et al.

(10) Patent No.: US 9,291,390 B2
(45) Date of Patent: Mar. 22, 2016

(54) PROCESS FOR PRODUCING PURIFIED SYNTHESIS GAS

(75) Inventors: Jacobus Eilers, Amsterdam (NL); Arjan Allert Jonckers, Amsterdam (NL); Leendert Johannes Arie Zoetemeijer, Rijswijk (NL)

(73) Assignee: Shell Oil Company, Houston, TX (US)

( * ) Notice: Subject to any disclaimer, the term of this patent is extended or adjusted under 35 U.S.C. 154(b) by 159 days.

(21) Appl. No.: 14/116,142

(22) PCT Filed: May 10, 2012

(86) PCT No.: PCT/EP2012/058649

§ 371 (c)(1),
(2), (4) Date: Jun. 13, 2014

(87) PCT Pub. No.: WO2012/152869

PCT Pub. Date: Nov. 15, 2012

(65) Prior Publication Data

US 2014/0331715 A1 Nov. 13, 2014

(30) Foreign Application Priority Data

May 11, 2011 (EP) ..... 11165677

(51) Int. Cl.

| | |
|---|---|
| ***B01D 47/00*** | (2006.01) |
| ***B01D 53/14*** | (2006.01) |
| ***F25J 3/08*** | (2006.01) |
| ***C10J 3/00*** | (2006.01) |
| ***C10K 1/00*** | (2006.01) |
| ***C10K 1/04*** | (2006.01) |
| ***C10K 1/10*** | (2006.01) |

(52) U.S. Cl.

CPC .... *F25J 3/08* (2013.01); *C10J 3/00* (2013.01); *C10K 1/003* (2013.01); *C10K 1/04* (2013.01); *C10K 1/101* (2013.01); *C10J 2300/1884* (2013.01); *C10J 2300/1892* (2013.01)

(58) Field of Classification Search

None

See application file for complete search history.

(56) References Cited

U.S. PATENT DOCUMENTS

| | | | | |
|---|---|---|---|---|
| 4,189,307 | A * | 2/1980 | Marion | C01B 3/52 252/373 |
| 4,233,137 | A | 11/1980 | Ozaki et al. | |
| 6,435,139 | B1 * | 8/2002 | Brucher | F22B 1/1884 122/30 |
| 2009/0152208 | A1 | 6/2009 | Agrawal | |
| 2011/0016788 | A1 | 1/2011 | Thacker et al. | |
| 2012/0111009 | A1 * | 5/2012 | Corry | C10J 3/86 60/662 |
| 2012/0256131 | A1 * | 10/2012 | Ko | C10J 3/84 252/373 |

FOREIGN PATENT DOCUMENTS

| | | |
|---|---|---|
| EP | 0291111 | 11/1988 |
| WO | 9603345 | 2/1996 |
| WO | 9639354 | 12/1996 |
| WO | 9722547 | 6/1997 |
| WO | 2007036236 | 4/2007 |
| WO | 200906841 | 1/2009 |

* cited by examiner

*Primary Examiner* — Duane Smith
*Assistant Examiner* — Phillip Shao

(57) ABSTRACT

Process for producing purified synthesis gas from soot-containing synthesis gas having a temperature of at least 5° C. above its dew point comprising the steps of (a) cooling the soot-containing synthesis gas to a temperature below its dew point by indirect heat exchange in a shell-tube heat exchanger without removing the condensate formed, thereby forming a synthesis gas/condensate mixture; and (b) contacting the synthesis gas/condensate mixture with a scrubbing liquid to remove the condensate resulting in a purified synthesis gas and used scrubbing liquid, wherein the soot-containing synthesis gas in step (a) is passed through the shell-tube heat exchanger at the tube side.

7 Claims, 1 Drawing Sheet

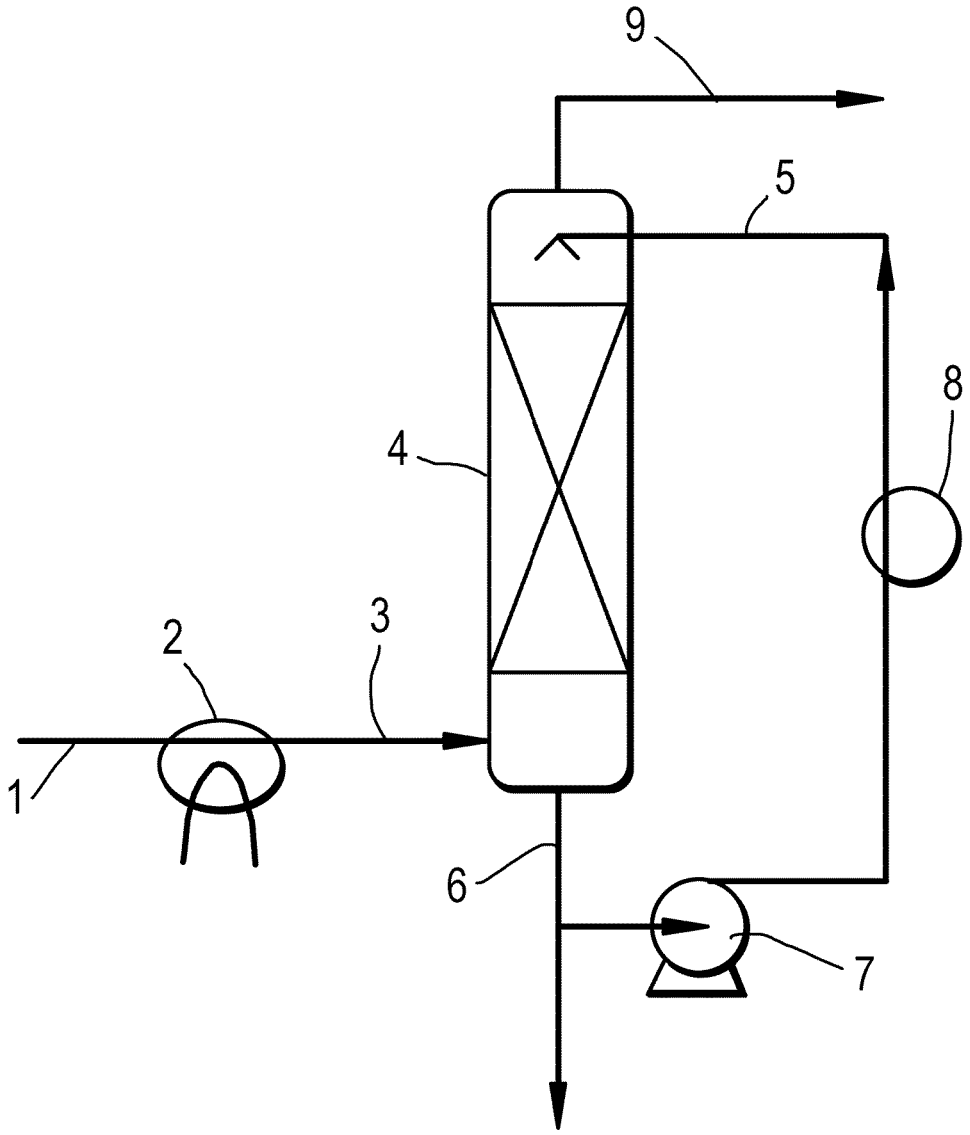
9
5
8
4
3
2
1
6
7

PROCESS FOR PRODUCING PURIFIED SYNTHESIS GAS

PRIORITY CLAIM

The present application is a National Stage (§371) application of International Application No. PCT/EP2012/058649, filed 10 May 2012, which claims the benefit of European Application No. 11165677.3, filed 11 May 2011, the disclosures of which are incorporated herein by reference.

BACKGROUND

The present invention relates to a process for producing purified synthesis gas from a soot-containing synthesis gas.

Processes for purifying synthesis gas are known in the art. For example, WO-A-2009/06841 discloses a process for purifying synthesis gas prepared by partial oxidation of a carbonaceous feedstock by mixing the synthesis gas produced with methanol, cooling the resulting mixture, separating a liquid water-methanol mixture from the cooled synthesis and contacting the cooled synthesis gas with methanol to decrease the content of hydrogen sulphide and carbon dioxide. At least part of the methanol used is regenerated and re-used in the process.

US-2009/0152208-A1 discloses a process for treating process water streams generated by a hydrocarbon gasification process, so that the water can be reused. As an important source of the water to be treated US-2009/0152208-A1 mentions the cooling of hot synthesis gas from a gasification process. The cooling method disclosed involves first and second stage cooling with solids removal inbetween. First stage cooling is typically achieved by non-contact heat exchange to a temperature below the dew point of the synthesis gas, thereby condensing part of the water present in the synthesis gas. Contaminants present in the synthesis gas (e.g. hydrogen sulphide, hydrogen chloride, ammonia, dissolved hydrocarbons) are absorbed into the condensate. The condensate is removed as a separate stream from the first stage cooling for further treatment, whilst the cooled synthesis gas is passed into a particulate removal system for removing any soot present. The soot-free synthesis gas subsequently flowing from the particulate removal system is passed into the second stage cooling. This second stage cooling takes place by direct cooling methods, such as quenching or scrubbing with water. The used contact cooling water is suitably combined with the condensate from the first stage cooling for further treatment. Any soot present in the synthesis gas is removed in a particulate removal system located between first and second stage cooling.

The present invention aims to provide an improved process for producing purified synthesis gas from a soot-containing synthesis gas.

SUMMARY OF THE INVENTION

Accordingly, the present invention relates to a process for producing purified synthesis gas from soot-containing synthesis gas having a temperature of at least 5° C. above its dew point comprising the steps of (a) cooling the soot-containing synthesis gas to a temperature below its dew point by indirect heat exchange in a shell-tube heat exchanger without removing the condensate formed, thereby forming a synthesis gas/condensate mixture; and (b) contacting the synthesis gas/condensate mixture with a scrubbing liquid to remove the condensate resulting in a purified synthesis gas and used scrubbing liquid, wherein the soot-containing synthesis gas in step (a) is passed through the shell-tube heat exchanger at the tube side.

DETAILED DESCRIPTION

One of the advantages of the process of the present invention is that the condensate formed in the process is removed together with the scrubbing liquid, thereby restricting the condensate-removal to a single step. Another advantage is that the process is very heat-efficient. An optimum amount of high quality heat is recovered in step (a) and hence can be used elsewhere in the process for producing synthesis gas, for example for heating boiler feed water that can be used to generate steam.

Gasification processes for producing synthesis gas are well known in the art. Gasification typically involves a partial oxidation step wherein a methane-containing feed reacts with an oxygen-containing gas to produce a mixture of carbon monoxide and hydrogen (i.e. synthesis gas). Examples of partial oxidation processes are, for example, described in EP-A-0 291 111, WO-A-97/22547, WO-A-96/39354 and WO-A-96/03345.

The hot synthesis gas product coming from the gasification reactor typically has a temperature of more than 1000° C., usually between 1100 and 1500° C. The synthesis gas may contain sour contaminants, such as hydrogen sulphide, and soot particles formed in the gasification reaction. The hot synthesis gas is cooled to a temperature above its dew point in one or more stages, typically by indirect heat exchange, to recover heat. The heat recovered can, for example, be used to produce steam.

Cooling by indirect heat exchange is well known and can be performed by heat exchangers known in the art. As long as the temperature of the synthesis gas remains higher than its dew point, no condensate is formed and both the soot and the sour contaminants will remain distributed in the synthesis gas. That means the heat exchange can take place under dry conditions and no special materials need to be used on the heat exchanger's internals. From an economic perspective that is attractive.

Accordingly, in a preferred embodiment of the present invention the soot-containing synthesis gas used as a feed in step (a) is prepared by gasification of a carbonaceous feedstock followed by cooling of the resulting hot soot-containing synthesis gas effluent to a temperature of at least 5° C. above its dew point. The cooling suitably takes place by indirect heat exchange using water as the cooling medium to produce steam. Preferably the soot-containing synthesis gas feed to the process of the present invention has a temperature of 5 to 50° C. above its dew point, more preferably 10 to 40° C. above its dew point and most preferably 15 to 30° C. above its dew point. Depending on the composition of the soot-containing synthesis gas formed in the actual gasification process and the amount of heat that can be effectively and economically removed from the hot synthesis gas effluent from this gasification process, this will typically mean that the actual temperature of the soot-containing synthesis gas used as a feed to step (a) will be higher than 140° C. Suitably, the temperature of the gas feed will be at least 145° C., suitably from 145 to 195° C., more suitably 150 to 180° C.

In step (a) of the process according to the present invention the soot-containing synthesis gas is subsequently further cooled to a temperature below its dew point. By cooling to below the dew point a condensate is formed which will contain most of the sour contaminants and soot present in the synthesis gas. The temperature to which cooling can take place may vary widely depending on the cooling medium used. For example, if the cooling medium is water of ambient temperature, then cooling of the soot-containing synthesis gas up to 80° C. below its dew point is feasible. If, on the other hand, preheated boiler feed water to produce steam elsewhere in the process is used as the cooling medium—such preheated boiler feed water would typically have a temperature between 70 and 120° C.—then the soot-containing synthesis gas is typically cooled in step (a) to a temperature which is up to 50° C. below its dew point. From a heat efficiency perspective it was found particularly advantageous to cool the soot-containing synthesis gas to a temperature in the range of from 2 to 40° C. below its dew point, more preferably from 5 to 25° C. below its dew point and most preferably from 5 to 15° C. below its dew point.

According to the present invention the cooling in step (a) takes place by indirect heat exchange in a shell-tube heat exchanger without removing the condensate formed, wherein the condensing, soot-containing synthesis gas is passed through the shell-tube heat exchanger at the tube side, preferably in counter-current flow to the cooling medium, typically water, which is passed through the heat exchanger at the shell side. By cooling in this way the condensate formed and the soot will pass through the tube of the shell-tube heat exchanger. The advantage of this mode of operation is that the flow of condensate and soot formed from the condensing soot-containing synthesis gas can be controlled because of a defined flow path. On the other hand, there is a risk that fouling and/or corrosion of the inside of the tube can occur as a result of the soot and sour contaminants present in the condensate.

In order to minimize fouling of the tube the velocity of the condensing soot-containing synthesis gas that flows through the tube of the shell-tube heat exchanger should be such that the pressure drop across the entire tube length stays within acceptable limits. The velocity of the condensing soot-containing synthesis gas stream through the tube has an impact on the fouling that could occur. At increasing velocities more soot passes through the tube, which provides more opportunity for deposition of soot on the heat transfer surface (i.e. the tube's inside wall) to occur. On the other hand, increasing velocities also increase the shear forces acting on the heat transfer surface, thereby aiding the removal of soot deposits. A suitable balance between these two effects should be attained. It was found that step (a) can be suitably performed at velocities of at least 3 m/s (meters per second), preferably at least 5 m/s and more preferably of at least 10 m/s. Maximum velocities are predominantly determined by tube diameter and tube length. Typically velocities will not exceed 50 m/s, more suitably 40 m/s.

The cooling medium at the shell side of the shell-tube heat exchanger used in step (a) could be any cooling medium, but the preferred cooling medium is water. In a preferred embodiment of the present invention water is used as the cooling medium at the shell-side of the shell-tube heat exchanger resulting in a heated water stream. This heated water stream can be used elsewhere in the gasification process line-up. For example, this heated water could suitably be used to produce steam by being used as at least part of the cooling medium in the heat exchangers for cooling the hot soot-containing synthesis gas effluent from the gasification reactor as described above. If in such an embodiment preheated water of 90 to 115° C. is used as the cooling medium and this water is used as boiler feed water to produce steam elsewhere in the process, for example in cooling the hot synthesis gas effluent from the gasification reactor, the temperature of the condensing synthesis gas in step (a)—and hence temperature of the gas/condensate effluent from step (a)—does not become lower than 115° C., more suitably not lower than 125° C.

The shell-tube heat exchanger can be any shell-tube heat exchanger. Shell-tube, or shell and tube, heat exchangers are well known in the art. They typically consist of a shell (or vessel) with a bundle of tubes inside it. One fluid flows through the tubes and another through the shell and over the tubes. In this way heat is transferred from one fluid to the other. Various types of shell-tube heat exchangers exist. Examples include U-tube heat exchangers and straight-tube heat exchangers with a one pass tube-side and a two pass tube-side.

A suitable and well known way of characterizing types of shell-tube heat exchangers is the characterization according to the standards of the Tubular Exchanger Manufacturers Association (TEMA). According to these TEMA standards a shell-tube heat exchanger is characterized by three letters: a first letter indicating the front-end stationary head type, a middle letter indicating the actual shell type used and a final letter indicating the rear end head type. Several TEMA type heat exchangers could be used, in particular those having a counter-current flow design for optimum heat transfer from the condensing synthesis gas at the tube side to the cooling medium at the shell side. It was found that the BFU type heat exchanger was particularly suitable. Such BFU type heat exchanger has a Bonnet stationary head (B), a two pass shell with longitudinal baffle as the shell type (F) and a U-tube bundle as the rear end stationary head (U). Other suitable types of heat exchangers include a BEM type heat exchanger with one or two tube passes and an AEM type heat exchanger.

The material of construction for the shell-tube heat exchanger, in particular those parts in direct contact with the condensing soot-containing synthesis gas, should be able to resist the corrosive components in the condensing synthesis gas. Furthermore, the material should be resistant to $CO/CO_2$ stress corrosion cracking, a well known phenomenon in water/condensing services with high $CO/CO_2$ partial pressures. It essentially is the interaction of corrosion and mechanical stress resulting in failure of a tube by corrosion cracking. Several stainless steel types could be used, for example SS316 grades (such as SS316, SS316L, SS316LN, SS316Ti) or SS317 grades (such as SS317L).

In step (b) of the process according to the present invention the synthesis gas/condensate mixture resulting from step (a) is contacted with a scrubbing liquid to remove the condensate resulting in a purified synthesis gas and used scrubbing liquid containing the soot and sour components that were contained in the condensate. The scrubbing liquid can be any scrubbing liquid suitable for removing the condensate and the components contained or dissolved therein. Examples of such scrubbing liquids include methanol, water and mixtures thereof. The preferred scrubbing liquid is water.

The scrubbing typically takes place in a scrubbing column in which the gas/condensate mixture enters the column at the bottom end and the scrubbing liquid enters the column at the upper end, so that the gas/condensate mixture can be effectively contacted with the scrubbing liquid. The condensate will be scrubbed from the gas/condensate mixture and the used scrubbing liquid containing the condensate—and hence the soot and sour contaminants that were contained in the condensate—leaves the scrubbing column at the bottom, whilst the cleaned synthesis gas leaves the column at the top to be further used.

The gas/condensate mixture resulting from step (a) will enter the scrubbing column at a temperature up to 80° C.

below its dew point. It is, however, preferred from an effective heat recovery perspective that this mixture has a temperature of at least 90° C., more preferably 115° C. and even more preferably of at least 125° C. The scrubbing liquid entering the scrubbing column at the top should have a temperature which is sufficiently low to effectively absorb heat from the gas/condensate mixture to be scrubbed and at the same time enables the cleaned synthesis gas to leave the column at the top at the desired temperature for further use. Typically the scrubbing liquid entering the scrubbing column has a temperature in the range of from 20 to 70° C., suitably 25 to 50° C., more suitably 30 to 45° C. Depending on the temperature of the incoming gas/condensate mixture, the used scrubbing liquid when leaving the scrubbing column will typically have an increased temperature of up to 100° C.

The used scrubbing liquid can be passed to a treating unit for removing the contaminants and possibly reusing the scrubbing liquid in the scrubbing column or otherwise use or safely dispose of the scrubbing liquid. If the scrubbing liquid is water, the used scrubbing water will be fed into a waste water treatment unit and the purified water can be reused and/or safely disposed of. In a preferred embodiment of the present invention part of the used scrubbing liquid leaving the scrubbing column is recycled to the top of the scrubbing column to be reused with intermediate cooling, whilst the remaining used scrubbing liquid is sent to a treating unit.

The invention is further illustrated by FIG. 1.

In FIG. 1 the wet synthesis gas feed (1) is passed through shell-tube heat exchanger (2) and the resulting synthesis/condensate mixture (3) is fed into the bottom of scrubber column (4), where it is contacted with scrubbing water fed into the top of the scrubbing column (4) through line (5). The used scrubbing water leaves the scrubbing column at the bottom through line (6) for further treatment. Part of the used scrubbing liquid is recycled to the top of the scrubbing column (4) via pump (7) and cooler (8). The clean synthesis gas leaves the scrubbing column at the top through line (9).

What is claimed is:

1. A process for producing purified synthesis gas from an initially cooled, soot-containing synthesis gas having a temperature of at least 5° C. above its dew point comprising the steps of (a) further cooling the soot-containing synthesis gas to a temperature below its dew point by indirect heat exchange in a shell-tube heat exchanger without removing condensate formed, thereby forming a synthesis gas/condensate mixture in which the condensate contains most of the soot and sour gas contaminates present in the synthesis gas; and (b) contacting the synthesis gas/condensate mixture with a scrubbing liquid to remove the condensate resulting in a purified synthesis gas and used scrubbing liquid, wherein the soot-containing synthesis gas in step (a) is passed through the shell-tube heat exchanger at the tube side.

2. A process according to claim 1, wherein the soot-containing synthesis gas used as a feed to step (a) is prepared by gasification of a carbonaceous feedstock followed by an initial cooling of resulting hot soot-containing synthesis gas effluent to a temperature of at least 5° C. above its dew point.

3. A process according the claim 2, wherein the initial cooling takes place by indirect heat exchange using water as a cooling medium to produce steam.

4. A process according to claim 1, wherein in step (a) water is used as a cooling medium at the shell side of the shell-tube heat exchanger resulting in a heated water stream.

5. A process according to claim 4, wherein the heated water stream is used as at least part of the water which is used as the cooling medium in the process.

6. A process-according to claim 1, wherein in step (a) the soot-containing synthesis gas is cooled to a temperature which is in the range of from 5 to 25° C. below its dew point.

7. A process according to claim 1, wherein the scrubbing liquid in step (b) is water.

* * * * *